US012161190B1

(12) United States Patent
Razon

(10) Patent No.: US 12,161,190 B1
(45) Date of Patent: Dec. 10, 2024

(54) SHOE WITH PIVOTING HEEL

(71) Applicant: Eli Razon, Maple Glen, PA (US)

(72) Inventor: Eli Razon, Maple Glen, PA (US)

( * ) Notice: Subject to any disclaimer, the term of this patent is extended or adjusted under 35 U.S.C. 154(b) by 0 days.

(21) Appl. No.: 16/600,647

(22) Filed: Oct. 14, 2019

Related U.S. Application Data

(60) Provisional application No. 62/825,292, filed on Mar. 28, 2019.

(51) Int. Cl.

| | |
|---|---|
| ***A43B 21/30*** | (2006.01) |
| ***A43B 21/32*** | (2006.01) |
| *A43B 5/04* | (2006.01) |
| *A43B 5/06* | (2022.01) |
| *A43B 7/144* | (2022.01) |
| *A43B 13/14* | (2006.01) |
| *A43B 13/18* | (2006.01) |
| *A43B 21/51* | (2006.01) |
| *A43B 23/08* | (2006.01) |

(52) U.S. Cl.
CPC ..... *A43B 21/30* (2013.01); *A43B 21/32* (2013.01); *A43B 5/0466* (2013.01); *A43B 5/06* (2013.01); *A43B 7/144* (2013.01); *A43B 13/143* (2013.01); *A43B 13/183* (2013.01); *A43B 13/185* (2013.01); *A43B 21/51* (2013.01); *A43B 23/08* (2013.01)

(58) Field of Classification Search
CPC ..... A43B 21/30; A43B 21/32; A43B 21/51; A43B 23/08; A43B 7/144; A43B 13/185; A43B 13/143; A43B 13/183; A43B 5/06; A43B 5/0466
USPC ..... 36/92, 132
See application file for complete search history.

(56) References Cited

U.S. PATENT DOCUMENTS

| | | | | |
|---|---|---|---|---|
| 357,062 | A * | 2/1887 | Buch | A43B 21/30 36/38 |
| 1,726,028 | A * | 8/1929 | Keller | A63B 25/10 36/7.8 |
| 2,508,318 | A * | 5/1950 | Wallach | A43B 21/30 36/38 |
| 2,555,654 | A * | 6/1951 | Ostrom | A43B 21/30 36/38 |
| 2,948,972 | A * | 8/1960 | Andersen | A43B 7/00 36/140 |
| 3,886,674 | A * | 6/1975 | Pavia | A43B 21/433 36/38 |
| 3,945,136 | A * | 3/1976 | Koo | A43B 21/30 36/38 |
| 4,492,046 | A * | 1/1985 | Kosova | A43B 13/183 36/27 |

(Continued)

OTHER PUBLICATIONS

Phases of the Gait Cycle Gait Analysis by ProtoKinetics (Year: 2018).*

*Primary Examiner* — Heather Mangine
*Assistant Examiner* — Dakota Marin
(74) *Attorney, Agent, or Firm* — Muskin and Farmer LLC

(57) ABSTRACT

A shoe with an integrally attached pivoting heel. The pivoting heel would rock back and forth between a pivot position and a flat position as a wearer of the shoe walks. The pivoting heel can have an upper plate connected to a lower plate via a rod, wherein the upper plate can rotate about the rod relative to the lower plate (or vice-versa). The pivoting heel can provide the wearer with more stability while the user walks and can help prevent slipping and falling.

5 Claims, 5 Drawing Sheets

(56) References Cited

U.S. PATENT DOCUMENTS 4,534,124 A * 8/1985 Schnell ..... A63B 25/10 36/114
4,592,153 A * 6/1986 Jacinto ..... A43B 1/0054 36/38
4,756,095 A * 7/1988 Lakic ..... A43B 7/02 36/2.6
4,894,934 A * 1/1990 Illustrato ..... A43B 21/26 36/102
5,282,325 A * 2/1994 Beyl ..... A43B 13/182 36/27
5,896,679 A * 4/1999 Baldwin ..... A43B 21/30 36/27
6,553,692 B1 * 4/2003 Chung ..... A43B 21/26 36/35 R
6,901,686 B2 * 6/2005 Hayes ..... A43B 5/0415 36/115
6,928,756 B1 * 8/2005 Haynes ..... A43B 13/183 36/38
7,059,069 B2 * 6/2006 Raluy ..... A43B 11/00 36/105
7,290,358 B2 * 11/2007 Francis ..... A43B 21/30 36/132
8,245,421 B2 * 8/2012 Baudouin ..... A43B 11/00 36/105
8,752,306 B2 * 6/2014 Goldston ..... A43B 7/1445 36/27
9,032,646 B2 * 5/2015 Perenich ..... A43B 13/181 36/102
9,066,559 B2 * 6/2015 Butler ..... A43B 13/386
10,021,936 B2 * 7/2018 Lee ..... A43B 13/183
11,583,032 B2 * 2/2023 Weast ..... A43B 5/06
2010/0139127 A1 * 6/2010 Huang ..... A43B 7/082 36/3 B
2016/0316852 A1 * 11/2016 Zhao ..... A43B 7/144
2018/0345119 A1 * 12/2018 Trunek ..... A63C 13/006
2020/0378462 A1 * 12/2020 Rennex ..... A43B 13/181

* cited by examiner

SHOE WITH PIVOTING HEEL

CROSS REFERENCE TO RELATED APPLICATIONS

This application claims benefit to U.S. provisional application 62/825,292, which is incorporated by reference herein in its entirety.

BACKGROUND OF THE INVENTION

Field of the Invention

The present general inventive concept is directed to a shoe with a pivoting heel.

Description of the Related Art

When man evolved, they walked mainly on "soft" surfaces such as mud and grass (and perhaps some rocks too). However, modern humans walk mainly on hard surfaces. Our heel did not evolve to walk on hard surfaces, and our current shoes do not address this problem. Walking on hard surfaces can cause repeated trauma to the walker's body when the heel bone hits the ground.

What is needed is an improved shoe which can counteract the negative effects of walking on hard surfaces and improve stability and health to the walker.

SUMMARY OF THE INVENTION

It is an aspect of the present invention to provide a shoe with a pivoting heel.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
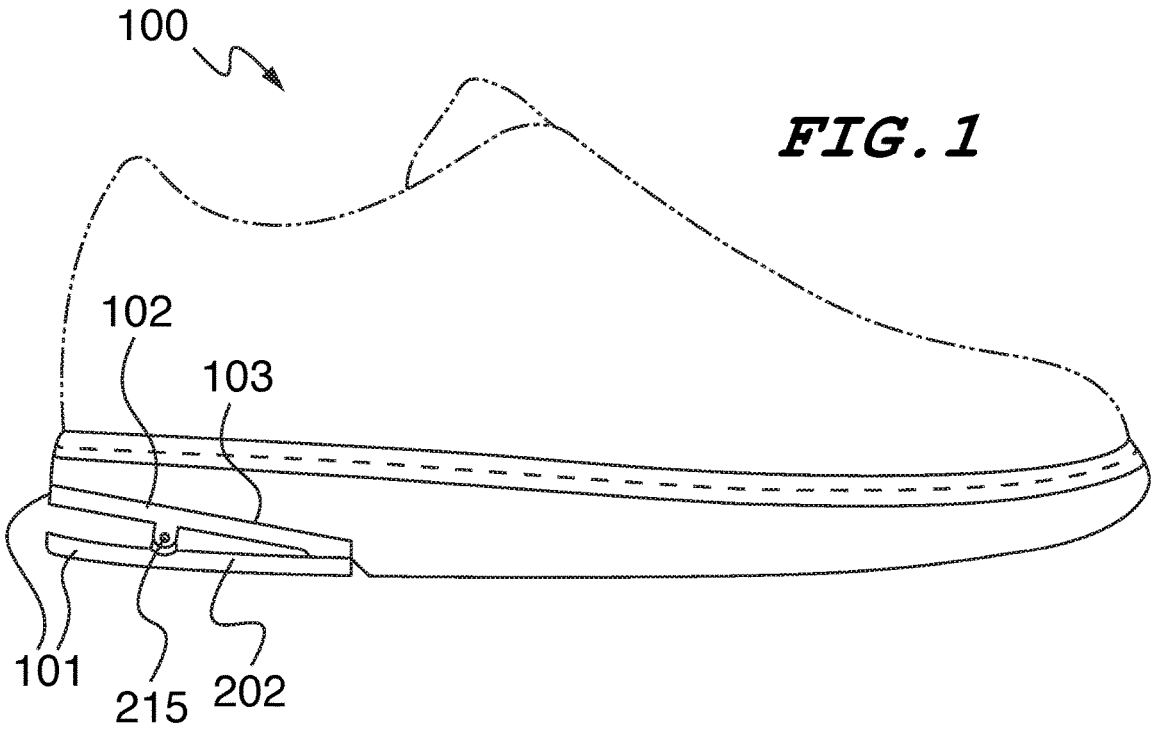
FIG. 1 is a side view of a shoe with a pivoting heel, according to an embodiment.

Reference will now be made in detail to the presently preferred embodiments of the invention, examples of which are illustrated in the accompanying drawings, wherein like reference numerals refer to like elements throughout.

FIG. 1 is a side view of a shoe with a pivoting heel, according to an embodiment.

A shoe 100 has a pivoting heel 101. A top 102 of the pivoting heel 101 (that is, a top surface of an upper plate 201) is affixed to the bottom rear 103 of the shoe 100 using an adhesive (glue, etc.) In another embodiment, the top 102 of the pivoting heel 101 can be affixed to the bottom of the shoe 100 using a mechanical attachment mechanism, such as nails, screws, snaps, etc. thus top 102 of the pivoting heel 101 (and hence the pivoting heel 101) is integrally attached to the shoe and typically cannot be easily removed. The top 102 of the pivoting heel 101 should be firmly and permanently attached to the bottom of the shoe 100 so the pivoting heel 101 would not shift relative to the shoe 100. The bottom rear of the shoe 100 should be configured in size and shape to match the upper plate 201 so that an entire top surface of the upper plate 201 would contact the bottom rear of the shoe 100 where it is permanently attached.

Figure 3:
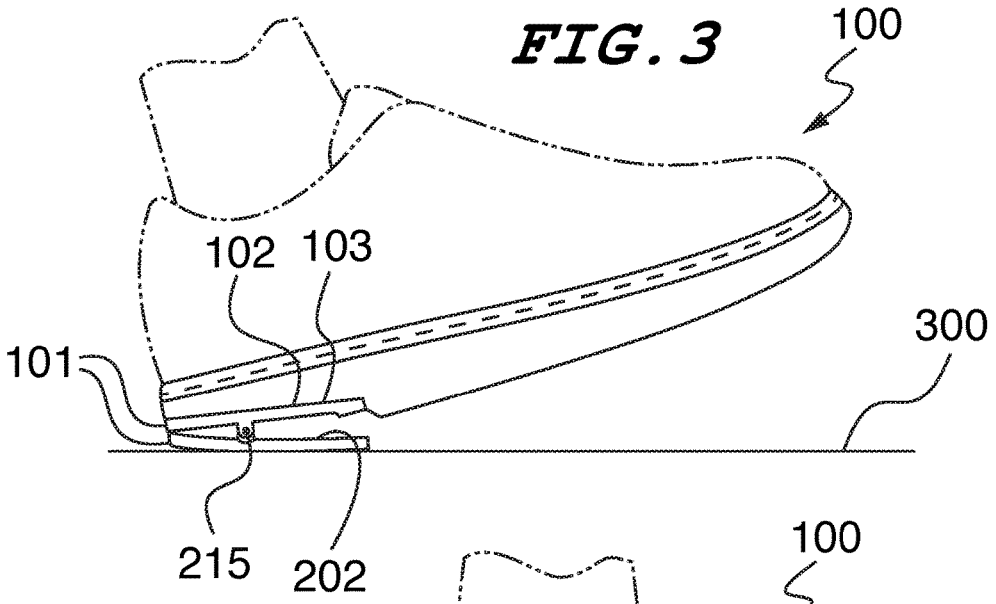
FIG. 3 is a side view of the shoe in a pivot position, according to an embodiment.

The pivoting heel 101 has two positions, a flat position (shown in FIG. 1) and a pivot position (shown in FIG. 3). As a user walks, the pivoting heel 101 would continuously shift between the flat position and the pivot position. The pivoting heel 101 would gradually rock back and forth between the two positions.

The pivoting heel 101 is spring loaded and would naturally rest in the flat position, while when walking the pivot position goes against the natural force of the spring(s).

Figure 2:
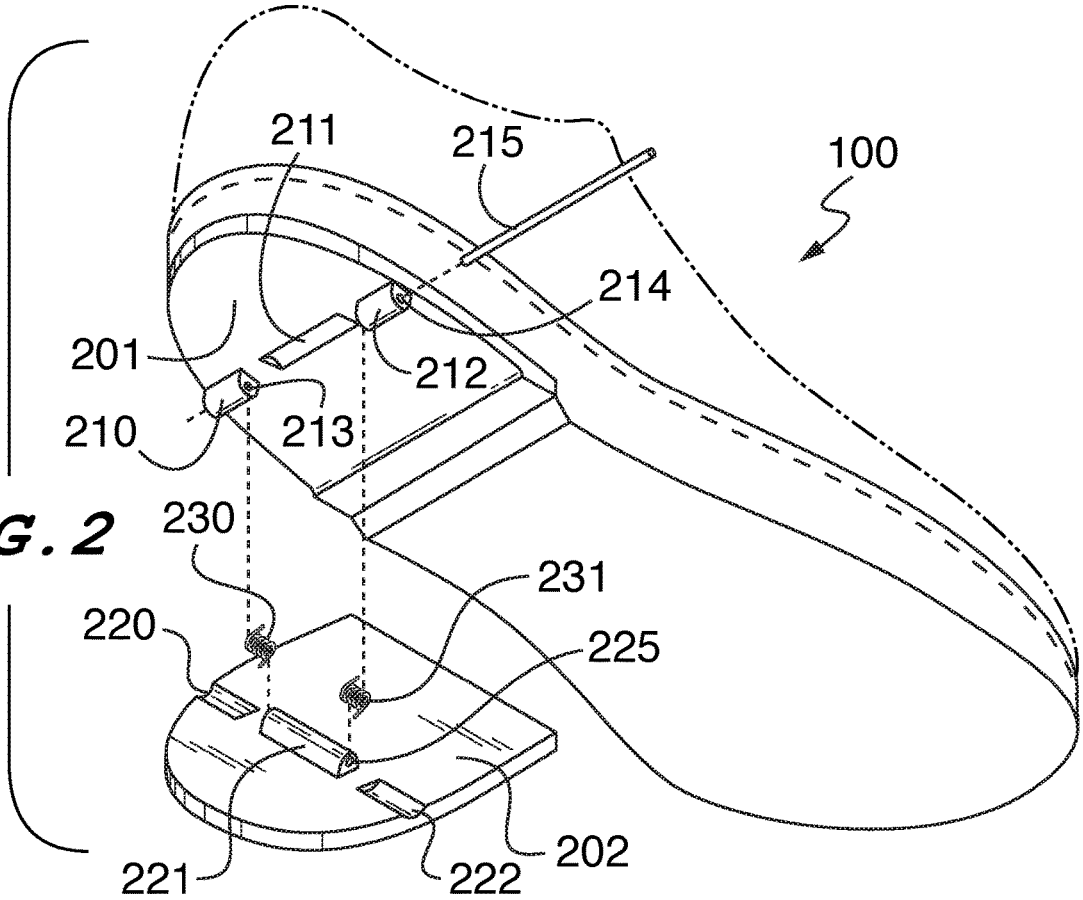
FIG. 2 is a bottom view of the shoe showing its assembly, according to an embodiment.

FIG. 2 is a bottom view of the shoe showing its assembly, according to an embodiment. Note that the top 102 from FIG. 1 is the top surface of an upper plate 201 (not shown in FIG. 2).

The pivoting heel 101 comprises the upper plate 201 and a lower plate 202. The upper plate 201 has attached to it an upper left protrusion 210 aligned with an upper right protrusion 212 with an upper indentation 211 between the upper left protrusion 210 and the upper right protrusion 212. The upper left protrusion 210 has a left hole 213 passing entirely therethrough, and the upper right protrusion 212 has a right hole 214 passing entirely therethrough. The left hole 213 and the right hole 214 are aligned thereby enabling a rod 215 to fit through both the left hole 213 and the right hole 214.

The lower plate 202 has a lower left indentation 220 aligned with a lower right indentation 222 with a lower protrusion 221 between the lower left indentation 220 and the lower right indentation 222. The lower protrusion 221 has a lower hole 225 passing entirely therethrough.

When the lower plate 202 is placed against the upper plate 201 as shown in FIG. 1, then: the lower protrusion 221 fits into the upper indentation 211, the upper left protrusion 210 fits into the lower left indentation 220, the upper right protrusion 212 fits into the lower right indentation 222. Thus, when all protrusions fit into their respective/corresponding indentation, the three protrusions 210, 212, 221 are all aligned (see FIG. 1).

To assemble the pivoting heel 101, the rod 215 passes through the right hole 214 in the upper right protrusion 212, through a right torsion spring 231, through the lower hole 225 in the lower protrusion 221, through a left torsion spring 230, and through the left hole 213 in the upper left protrusion 210. Thus, when the lower plate 202 is pressed against the upper plate 201 as shown in FIG. 1, the left hole 213, the lower hole 225, and the right hole 214 are all aligned in order for the rod 215 to pass therethrough all three holes. The left torsion spring 230 fits between the upper left protrusion 210 and the lower protrusion 221, and the right torsion spring 231 fits between the lower protrusion 221 and the upper right protrusion 212. The pivoting heel 101 can be assembled by first inserting the rod 215 through the right hole 214 and then the other holes, or by first inserting the rod 215 through the (not shown left side of the) left hole 213 and then through the other holes. Once the rod 215 is fully inserted through all three holes, then the lower plate 202 is attached to the upper plate 201 and would not fall off when the wearer (user) of the shoe 100 is walking. The rod 215 should be the same length as the width of the pivoting heel 101 at that particular location, in other rods should be long enough to span between a left end of the upper left protrusion 210 and a right end of the upper right protrusion 212. The rod is typically cylindrical and would fit snugly inside the three holes (213, 214, 225) so that it would not slide out and thus the upper plate 201 would remain attached to the lower plate 202 by virtue of the rod attaching the upper plate 201 to the lower plate 202 as described herein despite heavy usage (walking or running) by a user. The rod 215 can be considered an axis (or a pivot point) to which the upper plate 201 can rotate about relative to the lower plate 202.

Figure 4:
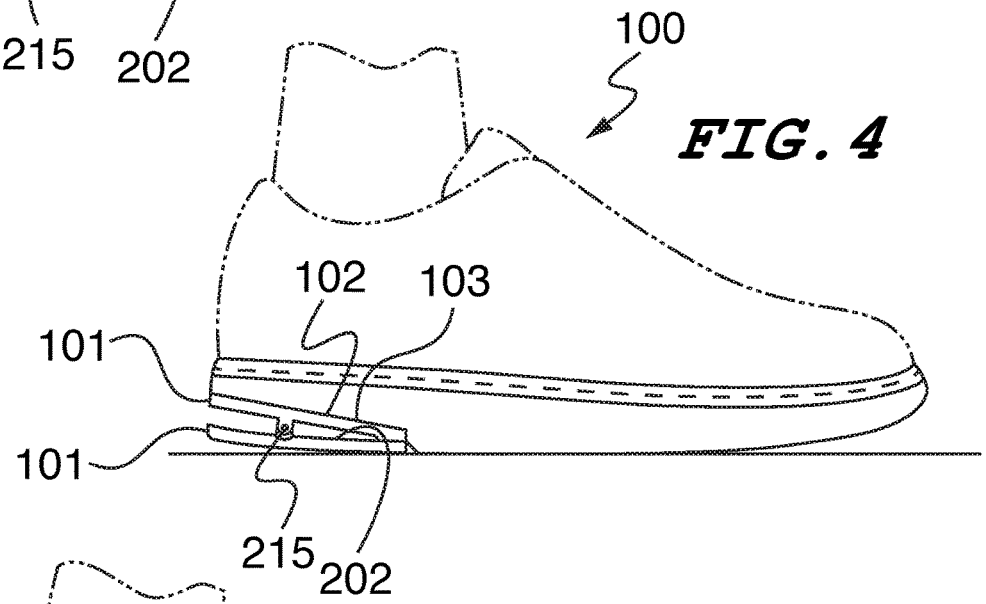
FIG. 4 is a side view of the shoe in a flat position, according to an embodiment.
Figure 5:
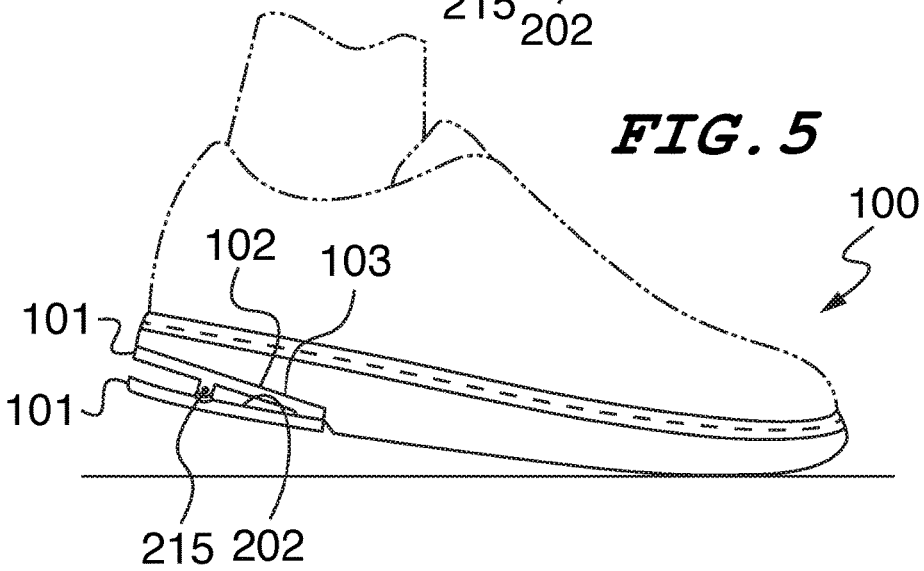
FIG. 5 is a side view of the shoe in a flat position with the pivoting heel 101 off the ground, according to an embodiment.

Both torsion springs 230, 231 are configured such that the natural force of the springs 230, 231 urges the lower plate to be into the flat position (shown in FIG. 1). The ends of each of the springs 230, 231 stick out (as shown in FIG. 2) thereby enabling each of the springs 230, 231 to operate against the upper plate 201 and the lower plate 202. As the user walks and pivots on a base of his/her heel, the pivoting heel 101 will gradually rock from the flat position into the pivot position, and then back to the flat position, and so on. While two springs 230, 231 are described and illustrated herein, the pivoting heel 101 can utilize number of springs (e.g., 1, 2, 3 or more) in order to configure the pivoting heel 101 to naturally return to the flat (or resting) position. Note that in the flat position (as seen in FIGS. 1, 4 and 5), a front of the upper plate 201 contacts a front of the lower plate 202, while a rear of the upper plate 201 is spaced apart from a rear of the lower plate 202.

Note that the structures on the upper plate 201 and the lower plate 202 can be reversed. That is, in an alternative embodiment, the upper plate 201 can have one protrusion and two indentations (as the lower plate in FIG. 2 does), and the lower plate 202 can have two corresponding protrusions and one corresponding indentation (as the upper plate in FIG. 2 does) which all fit into each other accordingly. In addition, the configuration shown in FIG. 2 is just one example, but it can be appreciated that any number of protrusions and corresponding indentations can be used.

Note that the rod 215 is approximately half-way between a front of the upper plate 201 and a rear of the upper plate 201, and similarly is also approximately half-way between a front of the lower plate 202 and a rear of the lower plate 202 (front/rear running perpendicularly to direction of the rod 215).

The shoe could be made of any materials that shoes can be made from (e.g., leather, cloth, plastic, etc.) The pivoting heel 101 (and all of its parts) can be made from any suitable material, such as hard plastic, metal, wood, etc. The rod 215 could be made from any suitable material such as metal (aluminum, steel, etc.) or other hard material.

When a person typically walks (or runs, etc.) the person would take a step and put their foot in a pivot position (shown in FIG. 3), and rest the foot flat on the ground in a flat position (shown in FIG. 4), and then lean the foot forward (shown in FIG. 5) as the person takes a step with their other foot. This process is identical in both feet and continues over and over.

FIG. 3 is a side view of the shoe in a pivot position, according to an embodiment. The user is pivoting on a base of his/her heel, which causes the pivoting heel 101 to rock into the pivot position (shown in FIG. 3). The backward weight on the pivoting heel 101 causes the pivoting heel 101 to rock into the "pivot" position (pivoting about the rod 215) shown in FIG. 3. Note that in the pivot position, a rear of the upper plate 201 contacts a rear of the lower plate 202, while a front of the upper plate 201 is spaced apart from a front of the lower plate 202. The lower plate 202 contacts the ground 300 (ground can also be a floor, etc.)

FIG. 4 is a side view of the shoe in a flat position, according to an embodiment. From the pivot position shown in FIG. 3, the user's foot rocks forward to the "flat" position shown in FIG. 4, wherein the forward weight pressing onto the pivoting heel 101 causes the pivoting heel 101 to rock into the pivot position (pivoting about the rod 215) shown in FIG. 4. In other words, the rod 215 can be considered a pivot axis as this is where the upper plate 201 pivots (rotates) about the lower plate 202 (and vice-versa).

FIG. 5 is a side view of the shoe in a flat position with the pivoting heel 101 off the ground, according to an embodiment. The user's foot would then step forward lifting the pivoting heel 101 off of the ground. The pivoting heel's 101 natural position (due to the natural force and configuration of the springs 230, 231) would be the flat position shown in FIGS. 4-5. In other words, when there is no force being applied to the pivoting heel 101, the springs 230, 231 cause the pivoting heel 101 to rock into the flat position (if not already in the flat position). From FIG. 5, the walker would lift the foot and then would step on the heel of the foot (as shown in FIG. 3) thereby causing the pivoting heel 101 to rock back into the pivot position (shown in FIG. 3).

Thus, when a user (wearer) wears both shoes that have the pivoting heel 101 as described herein, the pivoting heel 101 would serve to help absorb the impact when the wearer's heel strikes the ground (goes from the position illustrated in FIG. 5 to the position illustrated in FIG. 3). When the heel bone hits the ground, his/her body will now pivot around the rod and the pivoting heel 101 would serve as a "shock absorber" absorbing some of the energy of the impact. This would reduce the trauma of standard walking to the wearer's knee and hip. This could assist elderly wearers who may have weak bones. This can also help to stabilize the wearer's foot/leg which could prevent falls and prevent injuries in the knee and hip. The lower plate 202 also has a large surface area to press against the ground than a person's heel walking on a standard shoe, which could increase stability and reduce the chances of slipping and falling. For example, see FIG. 3 which shows that the lower plate 202 has much more surface area contacting the ground then if the walker was wearing a standard shoe in which only the heel of the shoe would be contacting the ground. When walking on a hard surface, the pivoting heel would provide better surface contact when the heel of the shoe contacts the ground which would benefit all joints. The surface area touching the ground ("ground contact surface area") when the heel touches the ground is greater than without the pivoting heel 101 in which a small portion of a standard shoe (the heel) would contact the ground. The greater the ground contact surface area, the more stable a walker would be. In addition, the surface area contacting the ground (the lower plate 202) would be flat, also increasing the stability. Thus, instead of putting all of the weight of the walker solely on the walker's heel bone, the pivoting heel 101 described herein can help distribute this weight across the walker's foot.

Figure 6:
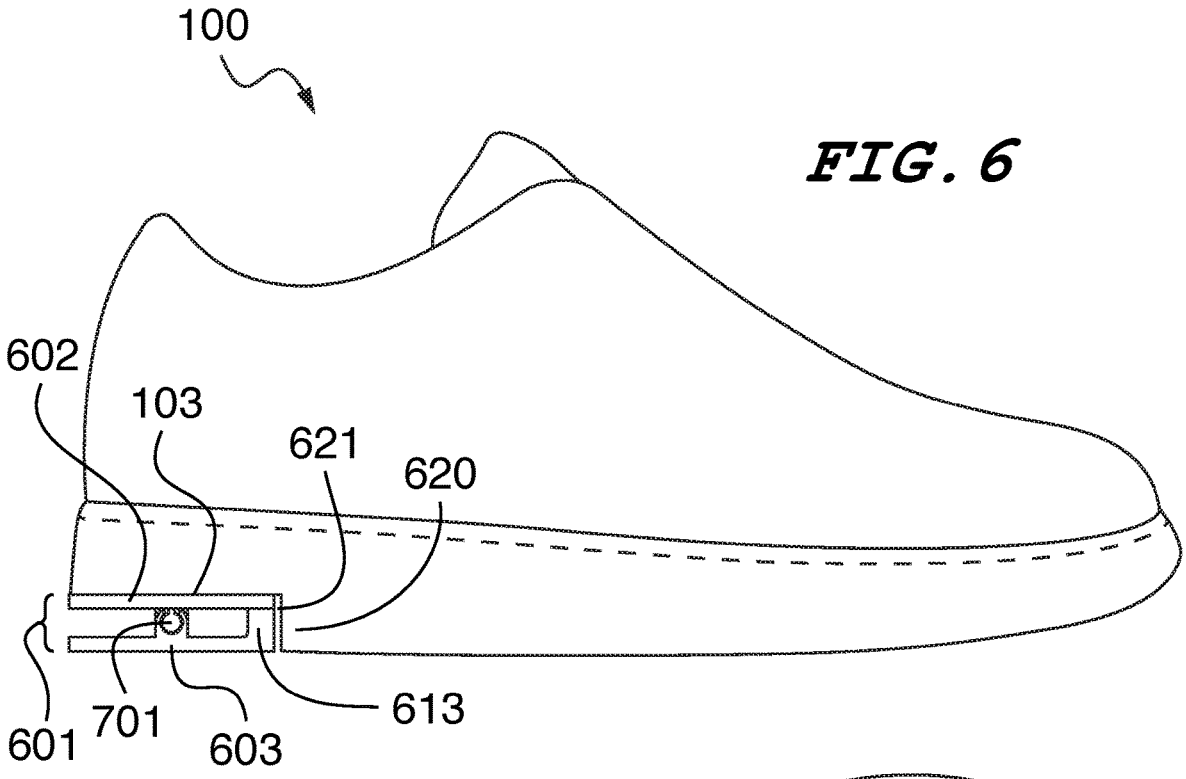
FIG. 6 is a side view of a shoe with a pivoting heel using a second assembly, according to an embodiment.

FIG. 6 is a side view of a shoe with a pivoting heel using a second assembly, according to an embodiment. A second assembly can be utilized which operates in the same manner as the pivoting heel 101. Note in this embodiment the second assembly does not utilize a spring.

A bottom rear 103 of the shoe 100 is attached (e.g., with an adhesive such as glue, etc.) to a top 602 of the second assembly 601 (all attachments to the second assembly and other assemblies can be done in the same manner as the pivoting heel 101). A bottom 603 of the second assembly 601 can be parallel to the top 602 of the second assembly 601 in the horizontal position.

A bottom sole 620 of the shoe 100 (soles are typically made out of rubber) is adjacent to a front 613 of the second assembly 601. In the horizontal position (shown in FIG. 6), the front 613 of the second assembly 601 is perpendicular to both the top 602 (upper plate) of the second assembly 601 and the bottom 603 (lower plate) of the second assembly 601 as shown. Note that there is a gap 621 (open space) between the front 613 of the second assembly 601 and the bottom sole 620. Note that the second assembly 601 does not utilize a spring.

Figure 7:
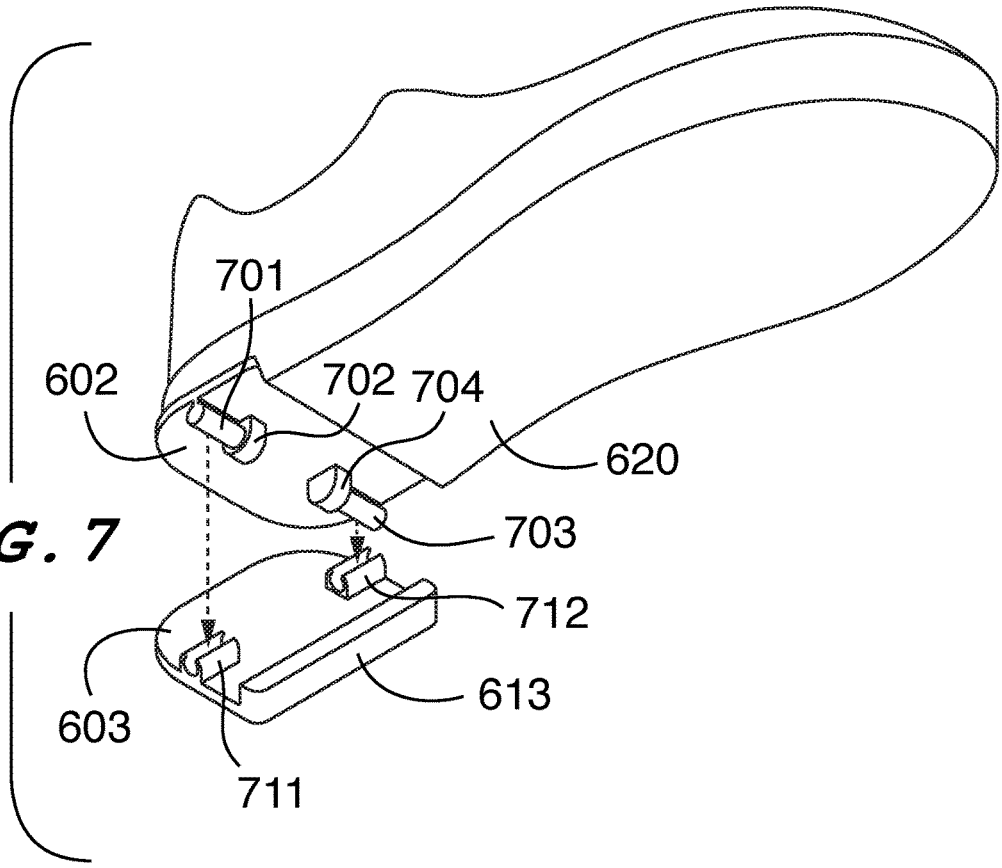
FIG. 7 is a bottom view of the shoe showing the second assembly, according to an embodiment.

FIG. 7 is a bottom view of the shoe showing the second assembly, according to an embodiment.

The bottom 603 of the second assembly 601 can be separated from the top 602 of the second assembly 601. The bottom 603 of the second assembly 601 can snap onto the top 602 of the second assembly 601 and can then remain snapped together (e.g., due to friction, etc.) Both the bottom 603 of the second assembly 601 and the top 602 of the second assembly 601 can be made out of a slightly malleable material (e.g., hard plastic, etc.) so that they can snap together but can also be pulled apart (with a large amount of manual force) when desired.

The top 602 of the second assembly 601 comprises a first rod 701 connected to a first stopper 702, and a second rod 703 connected to a second stopper 704. The top 602 of the second assembly 601 is integrally connected to the first rod 701, the first stopper 702, the second rod 703, and the second stopper 704. Note that the first stopper 702 is larger in diameter/size than the first rod 701, and the second stopper 704 is larger in diameter/size than the second rod 704. The bottom 603 of the second assembly 601 comprises a first pair of arms 711 and a second pair of arms 712. The first pair of arms 711 is configured to snap onto the first rod 701, and the second pair of arms 712 is configured to snap onto the second rod 703. The bottom 603 of the second assembly 601 is integrally connected to the first pair of arms 711 and the second pair of arms 712.

When the bottom 603 of the second assembly 601 is attached (snapped onto) the top 602 of the second assembly 601, then the top 602 of the second assembly 601 can pivot about the first rod 701 and the second rod 703. Of course, what "pivots" about/around what is relative, and it can also be said that the bottom 603 of the second assembly 601 can pivot about the first rod 701 and the second rod 703. Note that the first pair of arms 711 cannot slide (in a direction towards the second rod 703) off the first rod 701 because the size of the first stopper 702 (which is larger than the first pair of arms 711) would prevent the first pair of arms 711 from sliding off. Similarly, the second pair of arms 712 cannot slide (in a direction towards the first rod 701) off the second rod 703 because of the size of the second stopper 704 which is larger than the second pair of arms 712. As such, due to the first stopper 702 and the second stopper 704, the bottom 603 of the second assembly 601 cannot slide off the top 602 of the second assembly 601 when the bottom 603 of the second assembly 601 is attached to the top 602 of the second assembly 601.

Note that while FIG. 7 shows the rods 701, 703 and the stoppers 702, 704 attached to the top 602 and the pairs of arms 711, 712 attached to the bottom 603, this can also be reversed so that the rods 701, 703 and stoppers 702, 704 can be attached to the bottom 603 while the pairs of arms 711, 7122 are attached to the top 702. In this "opposite" configuration, the operation of the apparatus remains the same.

Figure 8:
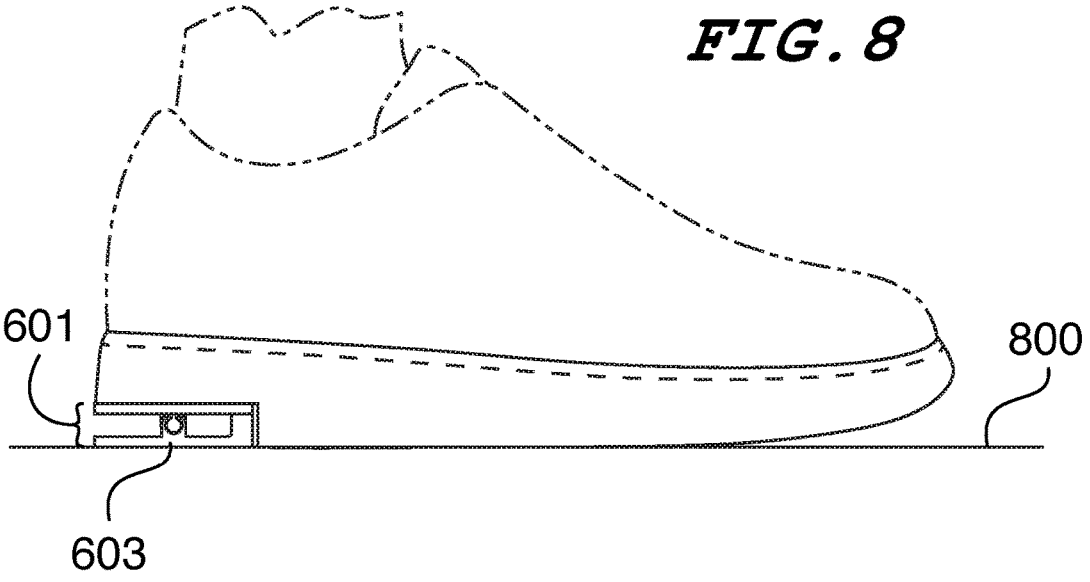
FIG. 8 is a side view of the shoe with the second assembly in a horizontal position, according to an embodiment.

FIG. 8 is a side view of the shoe with the second assembly in a horizontal position, according to an embodiment.

FIG. 8 shows the second assembly 601 flat on a ground 800 (or floor, etc.) The bottom 603 of the second assembly 601 is flat against the ground 800, wherein a surface area of the bottom 603 contacts the ground 800.

Figure 9:
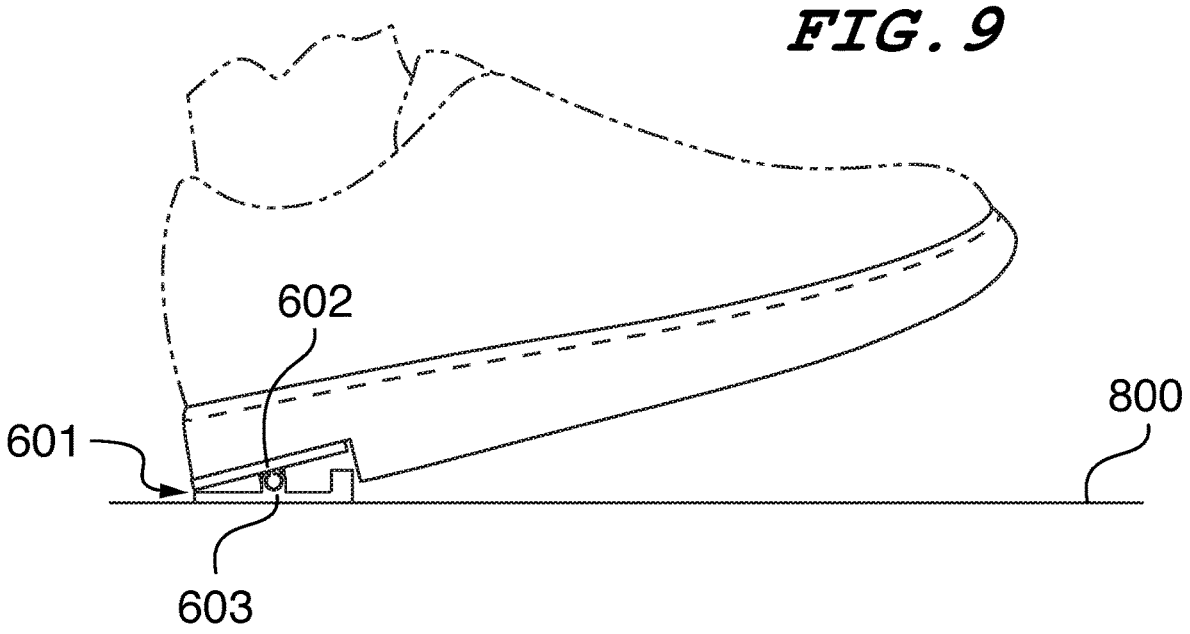
FIG. 9 is a side view of the shoe with the second assembly in a pivot position, according to an embodiment

FIG. 9 is a side view of the shoe with the second assembly in a pivot position, according to an embodiment.

The shoe 100 is now stepping with a heel of the shoe 100 contacting the ground 800 while the toe of the shoe 100 is elevated off the ground 800. Note that the top 602 of the second assembly 601 pivots about the first pair of arms 711 and the second pair of arms 712 (because the first rod 701 and the second rod 703 fits into and rotates inside the first pair of arms 711 and the second pair of arms 712, respectively). In this pivoted position, the bottom 603 of the second assembly 601 is still flat against the ground 800. As with the prior embodiment (pivoting heel 101), the bottom 603 provides more surface area contact against the ground 800 which can assist in preventing slipping, etc. In addition, the operation of the second assembly 601 (as with the pivoting heel 101) serves to reduce the impact of the heel on the ground 800.

The top 602 of the second assembly 601 is permanently affixed to the bottom rear 103 of the shoe 100. However, the bottom 603 can be snapped off (separated) from the top 602 (while the top 602 is affixed/attached to the bottom rear 103 of the shoe 100). In this manner, different bottom attachments other than the bottom 603 (which is a bottom attachment) can be attached to the top 602 (by snapping in the bottom attachment to the top 602 in the same manner as illustrated in FIG. 7). Different bottom attachments can each have a different function, and thus a user could snap on a desired bottom attachment on the shoe 100 that the wearer wishes to utilize.

Figure 10:
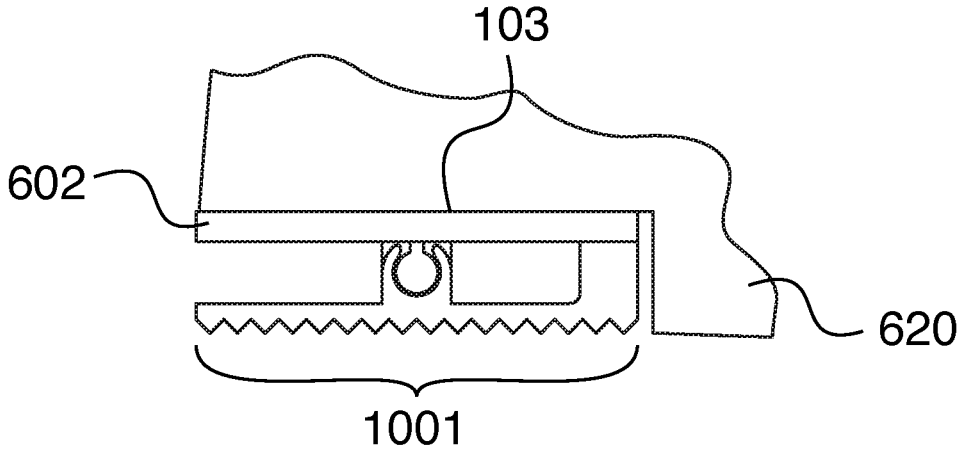
FIG. 10 is an enlarged view of the shoe with a third assembly, according to an embodiment.

FIG. 10 is an enlarged view of the shoe with a third assembly, according to an embodiment.

A jagged bottom attachment 1001 can be snapped onto the top 602. The jagged bottom attachment 1001 is a bottom attachment with a jagged bottom surface as shown in FIG. 10. The jagged bottom attachment 1001 is helpful to avoid slipping and could be used for slippery surfaces such as ice. The jagged bottom of the jagged bottom attachment 1001 has a bottom surface of continuous pointy edges and could "dig" into an icy surface, thereby providing a less slippery surface.

Figure 11:
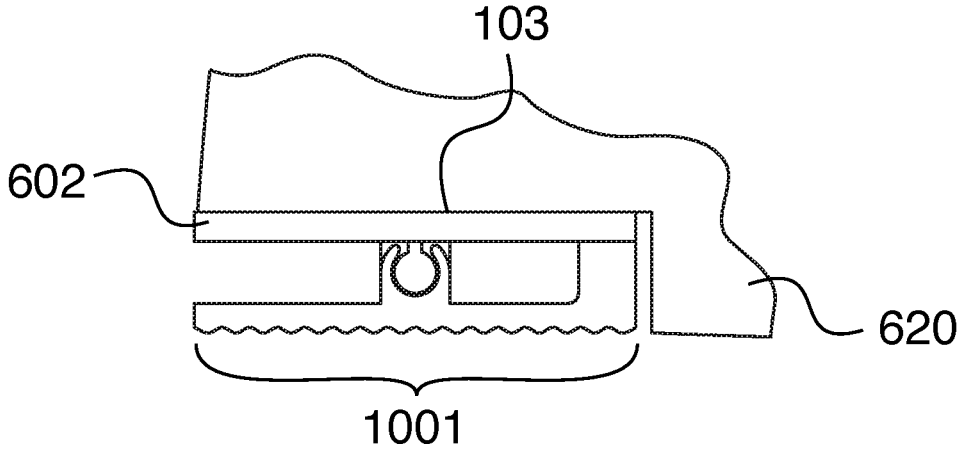
FIG. 11 is an enlarged view of the shoe with a fourth assembly, according to an embodiment.

FIG. 11 is an enlarged view of the shoe with a fourth assembly, according to an embodiment.

A wavy bottom attachment 1101 can be snapped onto the top 602. The wavy bottom attachment 1001 is a bottom attachment with a wavy bottom surface as shown in FIG. 11. The wavy bottom attachment 1101 is helpful to avoid slipping and could be used for muddy surfaces. The wavy bottom of the wavy bottom attachment 1101 has a bottom surface of continuous wavy sections and would increase the surface area that the wavy bottom attachment 1101 contacts with the ground and can help reduce slipping (especially on a grassy, muddy, or snowy surface).

It can be appreciated that numerous other bottom attachments can be devices for different purposes. The user can easily remove (by "unsnapping") a bottom attachment that may currently be attached to the top 602 of the second assembly 601 and snap in a different bottom attachment that the user may find appropriate for a particular application (walking in snow, ice, mud, etc.) The bottom attachments all operate in the same manner as described herein but provide different bottom surfaces which can assist with the particular surface the user is walking on.

The second assembly 601 and all of its parts (and in fact any part described herein) can be made out of hard plastic, soft plastic, pvc, wood, etc. The size of the first rod 701 and the second rod 703 should be sized appropriately to snap into the first pair of arms 711 and the second pair of arms 712, respectively so that the bottom 603 remains attached to the top 602 while a user is walking and would only become separate from the top 602 when a user manually exerts force to remove the bottom 603 from the top 602 (unsnapping the rods from their respective pair of arms). The material used for the first pair of arms 711 and the second pair of arms 712 could be slightly malleable in order to allow the respective rods to snap in and out without breaking, yet when the rods are snapped in the pairs of arms 711, 712 provide a secure fit/attachment to the rods 701, 703 yet enabling rotation of the rods 701, 703 inside the pairs of arms 711, 712 as shown.

When a person is walking, the person would shift from being supported by two legs to being supported by one leg and then back to two legs again. During the transition from being supported by two legs to a single leg, the pivoting heel can provide more stability to the legs.

"Shoe" as used herein can mean any article that fits around a foot and used for walking, which includes sneakers, etc. Of course, the wearer would be wearing two shoes and there can be two sets of every structure described herein, one for each foot/she.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A shoe, comprising:

an upper plate attached to a rear bottom of the shoe, wherein the upper plate comprises an upper plate front and an upper plate back, wherein the upper plate is confined to a heel portion of the shoe opposite a toe end of the shoe;

a lower plate comprising a lower plate front and a lower plate back; and a connection between the upper plate and the lower plate, wherein the connection is configured such that the lower plate rotates around the connection relative to the upper plate, wherein the connection and the upper plate and the lower plate are configured such that in a first position the upper plate front touches the lower plate front while the upper plate back does not touch the lower plate back, and in a second position the upper plate back touches the lower plate back while the upper plate front does not touch the lower plate front, wherein the connection comprises at least one protrusion in the upper plate.

2. A shoe, comprising:

an upper plate attached to a rear bottom of the shoe, wherein the upper plate comprises an upper plate front and an upper plate back, wherein the upper plate is confined to a heel portion of the shoe opposite a toe end of the shoe;

a lower plate comprising a lower plate front and a lower plate back;

a connection between the upper plate and the lower plate, wherein the connection is configured such that the lower plate rotates around the connection relative to the upper plate, wherein the connection and the upper plate and the lower plate are configured such that in a first position the upper plate front touches the lower plate front while the upper plate back does not touch the lower plate back, and in a second position the upper plate back touches the lower plate back while the upper plate front does not touch the lower plate front, wherein the connection comprises at least one protrusion in the lower plate.

3. The shoe as recited in claim 1, wherein the connection further comprises at least one protrusion in the lower plate and a rod inserted through the at least one protrusion in the upper plate and the at least one protrusion in the lower plate.

4. The shoe as recited in claim 2, wherein the connection further comprises at least one protrusion in the upper plate and a rod inserted through the at least one protrusion in the upper plate and the at least one protrusion in the lower plate.

5. The shoe as recited in claim 2, further comprising a spring contacting both the lower plate and the upper plate and configured to naturally return the lower plate to a position in which the upper plate front contacts the lower plate front.

* * * * *